US007787006B2

(12) United States Patent
Sakai et al.

(10) Patent No.: US 7,787,006 B2
(45) Date of Patent: Aug. 31, 2010

(54) IMAGE FORMING APPARATUS CAPABLE OF FORMING EXCELLENT IMAGE

(75) Inventors: Tetsuya Sakai, Hoi-gum (JP); Hironori Akashi, Okazaki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/802,364

(22) Filed: May 22, 2007

(65) Prior Publication Data

US 2008/0122918 A1 May 29, 2008

(30) Foreign Application Priority Data

Nov. 27, 2006 (JP) ..... 2006-318791

(51) Int. Cl.

| | |
|---|---|
| ***B41J 2/385*** | (2006.01) |
| ***B41J 2/40*** | (2006.01) |
| ***B41J 2/45*** | (2006.01) |
| ***B41J 2/47*** | (2006.01) |

(52) U.S. Cl. ..... 347/253; 347/130; 347/131; 347/143; 347/238; 347/240

(58) Field of Classification Search ..... 358/300
See application file for complete search history.

(56) References Cited

U.S. PATENT DOCUMENTS

| | | | | |
|---|---|---|---|---|
| 4,725,854 | A * | 2/1988 | Ohtsuka et al. | 347/247 |
| 6,198,494 | B1 | 3/2001 | Haraguchi et al. | |
| 6,636,251 | B2 * | 10/2003 | Saitou et al. | 347/131 |
| 6,690,486 | B1 * | 2/2004 | Ogoh et al. | 358/1.9 |
| 2002/0036688 | A1 * | 3/2002 | Saito et al. | 347/239 |

FOREIGN PATENT DOCUMENTS

| | | |
|---|---|---|
| JP | 10-217539 | 8/1998 |
| JP | 10-258547 | 9/1998 |
| JP | 2000-343756 | 12/2000 |
| JP | 2001-180036 | 7/2001 |
| JP | 2001-215762 | 8/2001 |
| JP | 2004-098589 | 4/2004 |
| JP | 2004-191827 | 7/2004 |
| JP | 2004-276582 A | 10/2004 |
| JP | 2004276582 A * | 10/2004 |
| JP | 2005-331658 | 12/2005 |
| JP | 2006-056173 | 3/2006 |

OTHER PUBLICATIONS

Japanese Office Action mailed on Oct. 21, 2008 directed towards a counterpart foreign application No. JP-2006-318791; 10 pages.

* cited by examiner

*Primary Examiner*—Matthew Luu
*Assistant Examiner*—Kendrick X Liu
(74) *Attorney, Agent, or Firm*—Morrison & Foerster LLP

(57) ABSTRACT

Differing ratios of the amount of light from light source LD2 to the amount of light from light source LD1 are provided. An image pattern for adjustment that includes, for each color, an area made up of isolated dots by light source LD1 and an area made up of isolated dots by light source LD2, is printed for each ratio. In a copier, a density of each area is detected, a ratio at which a difference between the density of an area of isolated dots by light source LD1 and the density of an area of isolated dots by light source LD2 is smallest is decided as an adjustment ratio, and control is performed such that light sources LD1 and LD2 emit light at the adjusted ratio.

9 Claims, 8 Drawing Sheets

IMAGE FORMING APPARATUS CAPABLE OF FORMING EXCELLENT IMAGE

This application is based on Japanese Patent Application No. 2006-318791 filed with the Japan Patent Office on Nov. 27, 2006, the entire content of which is hereby incorporated by reference.

BACKGROUND OF THE INVENTION

1. Field of the Invention

The present invention relates to an image forming apparatus, an image forming method, and an image forming program product. More particularly, the present invention relates to an image forming apparatus, an image forming method, and an image forming program product that create an image by a plurality of exposure light sources.

2. Description of the Related Art

In recent years, in an electrophotographic image forming apparatus such as an MFP (Multi Function Peripheral), in order to improve resolution, a multi-beam exposure method is often adopted in which by using a plurality of exposure light sources an image is created on a single image carrier. A representative multi-beam exposure method includes a two-beam exposure method in which laser beams are emitted from two exposure light sources.

When a multi-beam exposure method is adopted, variation in density resulting from differing sizes of dots created by laser beams may occur in an output image.

When printing is performed in an image forming apparatus that uses a multi-beam exposure method, because of differing intensities of lasers from light sources, variation in density may occur in an output image. To prevent the variation in density, the intensity of a laser from each light source is adjusted upon production. Japanese Laid-Open Patent Publication No. 2004-276582 (hereinafter, referred to as Patent Document 1) discloses an adjustment method in which by comparing image patterns, each composed of light from each light source, uniform density is obtained. Specifically, the adjustment method disclosed in Patent Document 1 is a method of correcting changes in the amounts of exposure from a plurality of light sources due to deterioration, by using an actual image by a laser beam from each light source. Upon the adjustment, each light source is fully exposed to create an image (solid image) and each image is outputted. In the method, to create the solid image, the number of rotations of a polygon motor is changed in such a manner that the interval between exposure-scanning by a laser beam from one light source to a photoconductor and exposure-scanning by another laser beam from a subsequent light source to the photoconductor is shortened.

The applicants of the present application have found that when in an image forming apparatus that uses a two-beam exposure method, a patch with a tone close to highlights is reproduced by using an error diffusion method, a bias of dots (referred to as isolated dots) in which a single light emission waveform by only one laser is included in a single dot occurs in a certain area and in an output image the bias of the isolated dots is conspicuous as woodgrain variation in density.

Here, given that a single light emission waveform of a beam from one light source LD1 is one shown in FIG. 12A and a single light emission waveform of a beam from the other light source LD2 is one shown in FIG. 12B, even if light outputs at peaks are the same, due to differing responsivities of the light sources, a difference occurs in the leading edge of a waveform before reaching a peak.

An area of a single light emission waveform obtained by a light emission output P and a time T represents a density. When differing light emission waveforms, such as those shown in FIGS. 12A and 12B, are included in a single dot, a difference in density occurs between an isolated dot by light source LD1 and an isolated dot by light source LD2. Hence, if any of isolated dots is biased, variation in density may occur in an output image.

Although it is verified that the variation in density is conspicuous when an error diffusion method with which a bias of dots is likely to occur is used, even when a screen tone reproduction method is used, if such a parameter that dots created by only one of lasers are biased in a certain area is selected, it is obvious that similar variation in density occurs. Hence, to prevent such variation in density that has been found by the applicants of the present application, an adjustment needs to be made such that identical reproduction of dots by lasers from light sources is obtained.

However, the method of adjusting the intensities of lasers from light sources, such as the one disclosed in Patent Document 1, is a method of adjusting the intensities of lasers when the light sources are fully exposed, and is not a method of making an adjustment such that identical reproduction of dots by lasers from light sources is obtained. That is, even if the interval between one exposure-scanning and subsequent exposure-scanning is shortened as is disclosed in Patent Document 1, an adjustment cannot be made such that identical reproduction of dots by lasers from light sources is obtained, causing a problem that variation in density resulting from that occurs.

SUMMARY OF THE INVENTION

The present invention is made in view of the problem. It is an object of the present invention to provide an image forming apparatus, an image forming method, and an image forming program product that are capable of forming an excellent image by making an adjustment such that identical reproduction of dots by lasers from light sources is obtained in an image forming apparatus that uses a multi-beam exposure method.

To achieve the above-described object, according to one aspect of the present invention, an image forming apparatus includes: a first exposure light source and a second exposure light source for forming a latent image on an image carrier; a storage unit to store image data for printing an image for adjustment; an adjusting unit to adjust an amount of light from the first exposure light source and an amount of light from the second exposure light source by using the image for adjustment; and a control unit to control a light emission intensity of the first exposure light source and a light emission intensity of the second exposure light source so as to render the amounts of light adjusted by the adjusting unit, wherein the image for adjustment includes, for each ratio of the light emission intensity of the first exposure light source and the light emission intensity of the second exposure light source, a first area composed of a first isolated dot formed by the first exposure light source and a second area composed of a second isolated dot formed by the second exposure light source, the adjusting unit includes a deciding unit to decide, for each ratio, an adjustment ratio based on a difference between a density of the first area and a density of the second area, and the control unit controls the light emission intensity of the first exposure light source and the light emission intensity of the second exposure light source so as to render the amount of light in the adjustment ratio.

According to another aspect of the present invention, an image forming method is an image forming method for an image forming apparatus including a first exposure light source and a second exposure light source for forming a latent image on an image carrier, the method including the steps of scanning an image for adjustment that is printed by the image forming apparatus, the image for adjustment including, for each ratio of a light emission intensity of the first exposure light source and a light emission intensity of the second exposure light source, a first area composed of a first isolated dot formed by the first exposure light source and a second area composed of a second isolated dot formed by the second exposure light source; reading, for each ratio, a density of the first area and a density of the second area in the image for adjustment; calculating, for each ratio, a difference between the density of the first area and the density of the second area; deciding an adjustment ratio based on the difference between the density of the first area and the density of the second area; and controlling, upon forming an image, the light emission intensity of the first exposure light source and the light emission intensity of the second exposure light source so as to render the amount of light in the adjustment ratio.

According to still another aspect of the present invention, an image forming program product is a program product that makes a computer as an image forming apparatus including a first exposure light source and a second exposure light source for forming a latent image on an image carrier, the program product causing the computer to perform the steps of: scanning an image for adjustment that is printed by the image forming apparatus, the image for adjustment including, for each ratio of a light emission intensity of the first exposure light source and a light emission intensity of the second exposure light source, a first area composed of a first isolated dot formed by the first exposure light source and a second area composed of a second isolated dot formed by the second exposure light source; reading, for each ratio, a density of the first area and a density of the second area in the image for adjustment; calculating, for each ratio, a difference between the density of the first area and the density of the second area; deciding an adjustment ratio based on the difference between the density of the first area and the density of the second area; and controlling, upon forming an image, the light emission intensity of the first exposure light source and the light emission intensity of the second exposure light source so as to render said amount of light in the adjustment ratio.

According to the present invention, in an image forming apparatus, a plurality of light sources are adjusted so as to obtain identical reproduction of dots by lasers. As a result, variation in density resulting from differing responsivities of the light sources can be suppressed, making it possible to form an excellent image.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
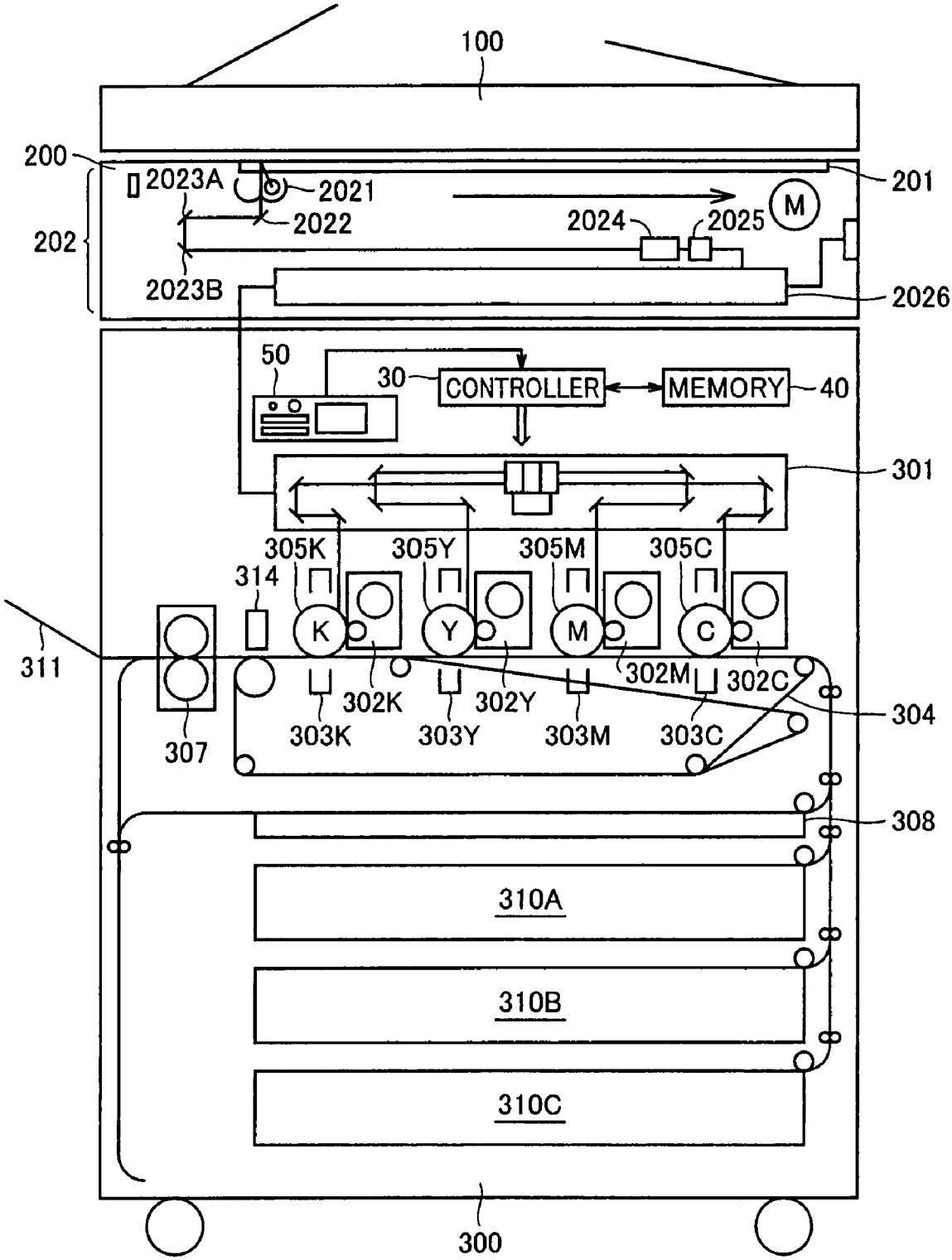
FIG. 1 is a schematic cross-sectional view showing an overview of a hardware configuration of a copier 1.

An embodiment of the present invention will be described below with reference to the drawings. In the following description, like parts and components are denoted by like reference numerals and the names and functions thereof are also the same.

In the present embodiment, the case in which an image forming apparatus according to the present invention is applied to a digital color copier using a tandem method (hereinafter, referred to as the "copier") will be described. However, the image forming apparatus according to the present invention is not limited to a copier and may be a printer, a facsimile apparatus, a MFP (Multi Function Peripheral) which is a multifunction product into which a printer and a facsimile apparatus are integrated, or the like. In addition, a printing method is not limited to a tandem method or a digital method and the image forming apparatus may be a monochrome copier instead of a color copier.

An image forming apparatus using a tandem color method includes image creating units of four colors, each including a developing unit, provided in a line along an intermediate transfer belt which is an intermediate transfer body. Toner images of the four colors formed on their corresponding image creating units are transferred (primary transfer) onto the intermediate transfer belt and by the toners of the four colors being overlaid on top of one another, a multicolor image is formed. Furthermore, the image overlaid on the intermediate transfer belt is transferred (secondary transfer) onto paper which is a print medium. The transferred image is then subjected to a fusing process and outputted.

Figure 2:
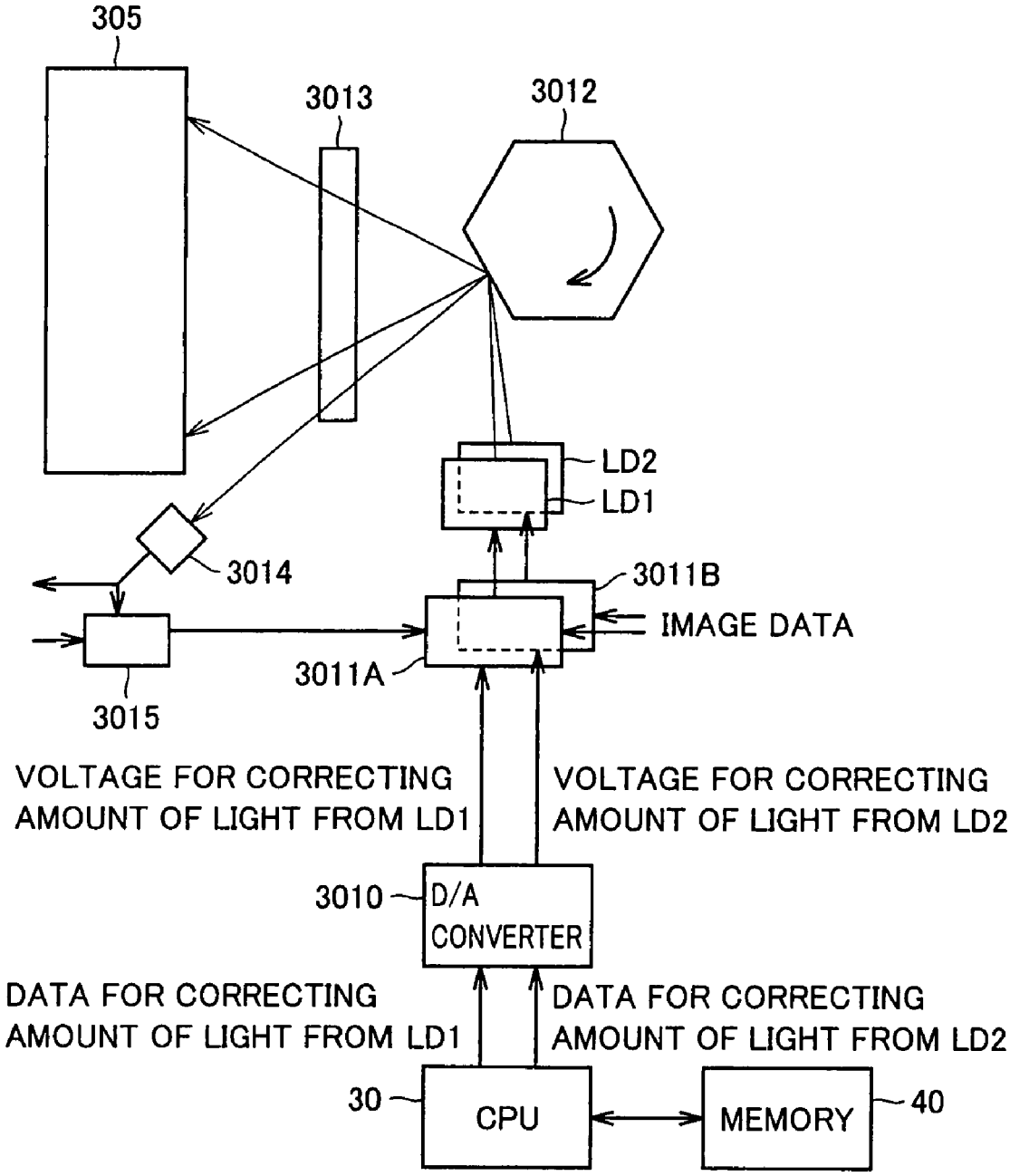
FIG. 2 is a schematic cross-sectional view for describing an exposure unit 301.

FIG. 1 is a schematic cross-sectional view showing an overview of a hardware configuration of a copier 1 according to the present embodiment, to which the image forming apparatus according to the present invention is applied. FIG. 2 is a schematic cross-sectional view for describing a part of copier 1. Copier 1 is a digital color copier using a tandem method, and forms a color image by sequentially overlaying toners of four colors including yellow (Y), magenta (M), cyan (C), and black (K).

With reference to FIG. 1, copier 1 according to the present embodiment includes an automatic document transporting unit 100, an image reading unit 200, and an image forming unit 300.

Automatic document transporting unit 100 automatically transports set documents to image reading unit 200 one sheet by one sheet.

Image reading unit 200 includes a document table glass 201 and a scanner 202 that moves in parallel with document table glass 201 by a scan motor M. Scanner 202 includes an exposure lamp 2021 that irradiates a document; a reflecting mirror 2022 that changes the direction of reflected light from the document; two mirrors 2023A and 2023B that change the optical path from reflecting mirror 2022; a lens 2024 that collects the reflected light; a half mirror 2025 that determines a color by the wavelength of the reflected light and reflects or transmits the reflected light and guides the reflected light to two photoelectric conversion elements; and a photoelectric conversion element 2026 such as a CCD (Charge Coupled Device) that generates an electrical signal according to the received reflected light.

A document transported from automatic document transporting unit 100 is set on document table glass 201 and is exposed and scanned when scanner 202 moves in a rightward direction shown by an arrow. Reflected light from the document is converted into an electrical signal by photoelectric conversion element 2026 and the electrical signal is inputted to image forming unit 300.

Image forming unit 300 includes an intermediate transfer belt 304 formed as an endless belt suspended by a plurality of rollers so as not to sag, and rotates, as a result of counterclockwise rotation of rollers in FIG. 1, in the same direction at a predetermined speed; photoconductors 305Y, 305M, 305C, and 305K (these are representatively referred to as photoconductors 305) that are disposed along intermediate transfer belt 304 with a predetermined spacing therebetween and that correspond to toners of different colors including yellow (Y), magenta (M), cyan (C), and black (K), respectively; developing units 302Y, 302M, 302C, and 302K (these are representatively referred to as developing units 302), each including i) a charger that uniformly charges a surface of a corresponding one of photoconductors 305 and ii) a development roller that develops an electrostatic latent image formed on the surface of the corresponding one of photoconductors 305 with a corresponding color toner and thereby forms a toner image on the surface of the corresponding one of photoconductors 305; transfer chargers 303Y, 303M, 303C, and 303K (these are representatively referred to as transfer chargers 303), which are respectively paired with the corresponding photoconductors 305 with intermediate transfer belt 304 therebetween and transfer the toner image formed on the surface of the corresponding photoconductors 305 onto intermediate transfer belt 304; an exposure unit 301 including a print head that outputs a laser beam to each photoconductor 305 based on each color data composing image data and thereby performs exposure according to the image data and forms an electrostatic latent image on the uniformly charged surface of each photoconductor 305; paper feed cassettes 310A, 310B, and 310C (these are representatively referred to as paper feed cassettes 310) that hold paper which is a print medium; a fusing unit 307 that transfers the toner images transferred onto intermediate transfer belt 304 to paper and fuses the images; a reflection-type photosensor (hereinafter, referred to as a sensor) 314 that detects the amount of toner adhered onto intermediate transfer belt 304; a paper ejection tray 311 that ejects printed paper; a controller 30 that includes a CPU (Central Processing Unit) and the like; a memory 40 that stores a program to be executed by controller 30, and the like; and an operation panel 50 that inputs an instruction operation from a user.

Operation panel 50 inputs an instruction signal according to an instruction operation from the user, such as power-on or start of printing to controller 30. Controller 30 reads and executes a program from memory 40 based on the instruction signal and controls the above-described units. Controller 30 may include therein a timing unit, such as a timer, and execute a program when a predetermined period of time is timed. Note that controller 30, memory 40, and operation panel 50 may be provided in automatic document transporting unit 100 or image reading unit 200 instead of in image forming unit 300.

By controller 30 executing the above-described program, controller 30 performs predetermined image processing on an image signal inputted from image reading unit 200, an external apparatus, or the like, and creates a digital signal which is color-converted into colors of yellow, magenta, cyan, and black.

In addition, by controller 30 executing the above-described program, controller 30 performs a process of adjusting the ratio of the amounts of laser light from light sources, as will be described later, based on an electrical signal inputted from photoelectric conversion element 2026 in image reading unit 200 and creates correction data which is a digital signal.

Image data such as image color data for cyan, image color data for magenta, image color data for yellow, and image color data for black that are created by controller 30 to form the above-described image, or data for a pattern image to be used for an image stabilization process, as will be described later, or the like, and a digital signal such as correction data for correcting the amount of light from a light source are outputted to exposure unit 301 from controller 30.

Based on image color data for each color or data for a pattern image that is inputted from controller 30, exposure unit 301 outputs a laser beam to each photoconductor 305.

With reference to FIG. 2, exposure unit 301 includes light sources LD1 and LD2, such as semiconductor laser elements, which are a plurality of light sources; drive circuits 3011A and 3011B (these are representatively referred to as drive circuits 3011) that drive the light sources, respectively; a D/A converter 3010; a polygon mirror 3012; an f-θ lens 3013, a photodiode (SOS: Start of Scan sensor) 3014; and an SOS sensor control unit 3015.

Correction data for each light source from controller 30 is converted into an analog signal by D/A converter 3010 and then the analog signals are inputted to drive circuits 3011, respectively. Image data is also inputted to the drive circuits 3011. Based on these data, drive circuits 3011 generates drive signals for driving light sources LD1 and LD2 and input the drive signals to light sources LD1 and LD2. Light sources LD1 and LD2 emit laser beams according to the drive signals.

The laser beams emitted from light sources LD1 and LD2 according to the drive signals each enter a single surface of polygon mirror 3012. Beams reflected off the surface pass through f-θ lens 3013 and then enter a photoconductor 305 and thereby expose the photoconductor 305. Along with rotation of polygon mirror 3012, the emission direction of a beam reflected from a single surface of polygon mirror 3012 changes, as shown in the drawing, the photoconductor 305 is subjected to exposure-scanning in an axial direction. Upon start of exposure-scanning of the photoconductor 305, a laser beam is reflected off a mirror (not shown) and enters SOS sensor 3014. SOS sensor 3014 inputs an SOS signal according to the laser beam to SOS sensor control unit 3015. SOS sensor control unit 3015 inputs control signals for controlling emission of laser beams from light sources LD1 and LD2 to drive circuits 3011 so as to synchronize exposure-scanning of the photoconductor 305 in the axial direction.

In an electrophotographic image creation process, the quality of an image is susceptible to an environment such as temperature or humidity. Hence, to guarantee the quality of an image, normally, an image stabilization process is performed at predetermined timing such as when the power is turned on or when there is an instruction for printing or when sheets of a predetermined number have been printed. The image stabilization process is a process for stabilizing the quality of an image by detecting, using a density sensor, adhesion of toners on photoconductors or an intermediate transfer belt. In the present embodiment, an image stabilization process is performed when there is an instruction for printing.

The image stabilization process is a process of performing, in order that an output image of an electrophotographic image forming apparatus can be obtained with stable density and tone reproduction independent of variations in environment or machine, self-diagnostics on the conditions of the inside of the machine by using a sensor, and changing the charging voltages of photoconductors of the image forming apparatus, the amount of laser light, or the like.

In copier 1 according to the present embodiment, as an image stabilization process, the process of adjusting the ratio of the amounts of light of laser beams emitted from light sources LD1 and LD2 is performed. Another representative image stabilization process includes, for example, control performed such that a pattern image with a predetermined density is formed on photoconductors or an intermediate transfer belt, the density of the pattern image is read by a sensor, and set values such as the charging voltages of the photoconductors and a development bias voltage are determined based on the value of the read density.

Note that although, in the following specific example, an adjustment process is performed when an image stabilization process is performed, timing at which the adjustment process is performed is not limited to when the image stabilization process is performed. Factors that exert an influence when dots are created in an exposure unit include, for example:

- photoconductors or an intermediate transfer belt have(has) been changed;
- durability of the photoconductors and the exposure unit is deteriorated; and
- an environment such as temperature or humidity is changed beyond the acceptable range.

Hence, the adjustment process may be performed when any of events such as those described above is detected, instead of when the image stabilization process is performed.

Figure 3:
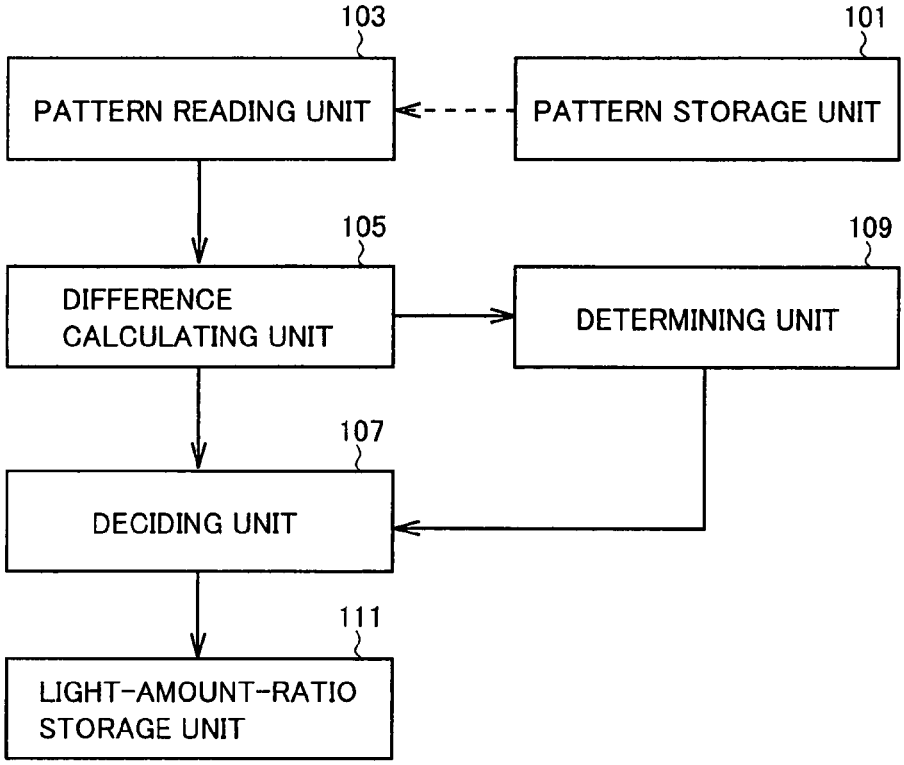
FIG. 3 is a block diagram showing a specific example of a function configuration for performing a process of adjusting the ratio of the amounts of light of laser beams emitted from light sources LD1 and LD2 by image stabilization control.

Functions shown in FIG. 3 are formed mainly on controller 30 by controller 30 reading and executing an image stabilization control program stored in memory 40. Some of the functions shown in FIG. 3 may be implemented by the hardware configuration of copier 1 shown in FIGS. 1 and 2.

With reference to FIG. 3, a function of copier 1 to perform the process of adjusting the ratio of the amounts of light of laser beams emitted from light sources LD1 and LD2 by image stabilization control includes a pattern storage unit 101 that stores image data for generating an image pattern which is a pattern for adjusting a light amount ratio; a pattern reading unit 103 that reads a density of the image pattern generated based on the image data; a difference calculating unit 105 that calculates a difference in density from a detected value; a deciding unit 107 that decides the ratio of the amounts of light from light sources LD1 and LD2 based on the difference in density; a determining unit 109 that determines a magnitude relationship between the difference in density and a threshold value; and an light-amount-ratio storage unit 111 that stores the decided ratio of the amounts of light from light sources LD1 and LD2.

Pattern storage unit 101 mainly corresponds to a memory included in controller 30, a predetermined area of memory 40, or the like. Pattern storage unit 101 stores therein image data for generating an image pattern for adjusting a light amount ratio.

Figure 4:
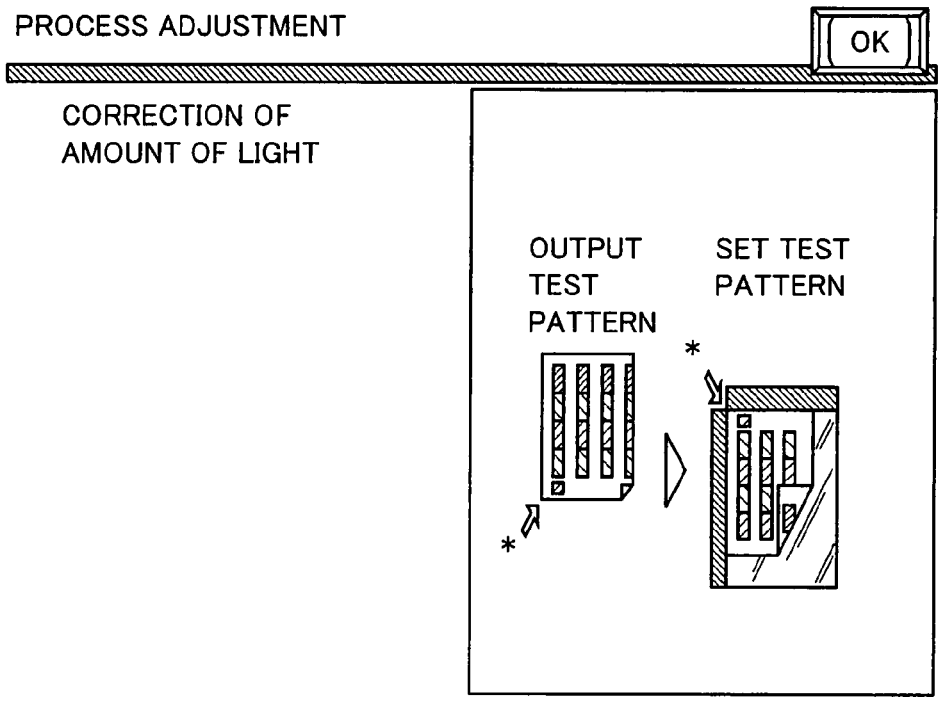
FIG. 4 illustrates a specific example of a screen for adjustment of a light amount ratio.

Upon generating an image pattern based on the image data, a user uses a menu screen (not shown) displayed on operation panel 50 to display a screen for performing the process of adjusting a light amount ratio, such as the one shown in FIG. 4, and performs an operation for instructing to output an image pattern. When controller 30 receives an instruction signal according to the operation, controller 30 performs, in image forming unit 300, the process of generating an image pattern based on the image data.

An example of image patterns for adjustment includes patterns made up of images generated by light sources LD1 and LD2 for difference ratios, in which one of light sources LD1 and LD2 is used as a reference light source and the amount of light from the reference light source is fixed and the ratio of the amount of light from the other light source to the amount of light from the reference light source is gradually changed. In a specific example in FIG. 5, there are shown image patterns made up of a pattern 1 in which the amount of light from light source LD1 is fixed and the amount of light from light source LD2 is increased by 3% over the amount of light from light source LD1, a pattern 2 with a 2% increase, a pattern 3 with a 1% increase, a pattern 4 with an equal amount of light, a pattern 5 with a 1% reduction, a pattern 6 with a 2% reduction, and a pattern 7 with a 3% reduction. The patterns 1 to 7 each include areas of different colors including yellow (Y), magenta (M), cyan (C), and black (K).

A method of changing the amount of light from light source LD2 over the amount of light from light source LD1 includes a method in which a current to be fed through light source LD1 is fixed and a current to be fed through light source LD2 is changed. For example, to change the amount of light from light source LD2 by +1% over the amount of light from light source LD1, given that a current to be fed through light source LD1 is I0, a current of 1.01*I0 should be fed through light source LD2. When, by using a chart created in this manner, an adjustment ratio for two lasers is decided upon controlling the amounts of light from both light sources LD 1 and LD2 based on the adjustment ratio too, such a current value ratio can be used. Another method for creating a chart includes a method in which the amounts of light outputted from both light sources LD1 and LD2 are measured and currents to be fed through both light sources LD1 and LD2 are controlled such that the amount of light from light source LD2 is +1% greater than the amount of light from light source LD1.

Figure 5:
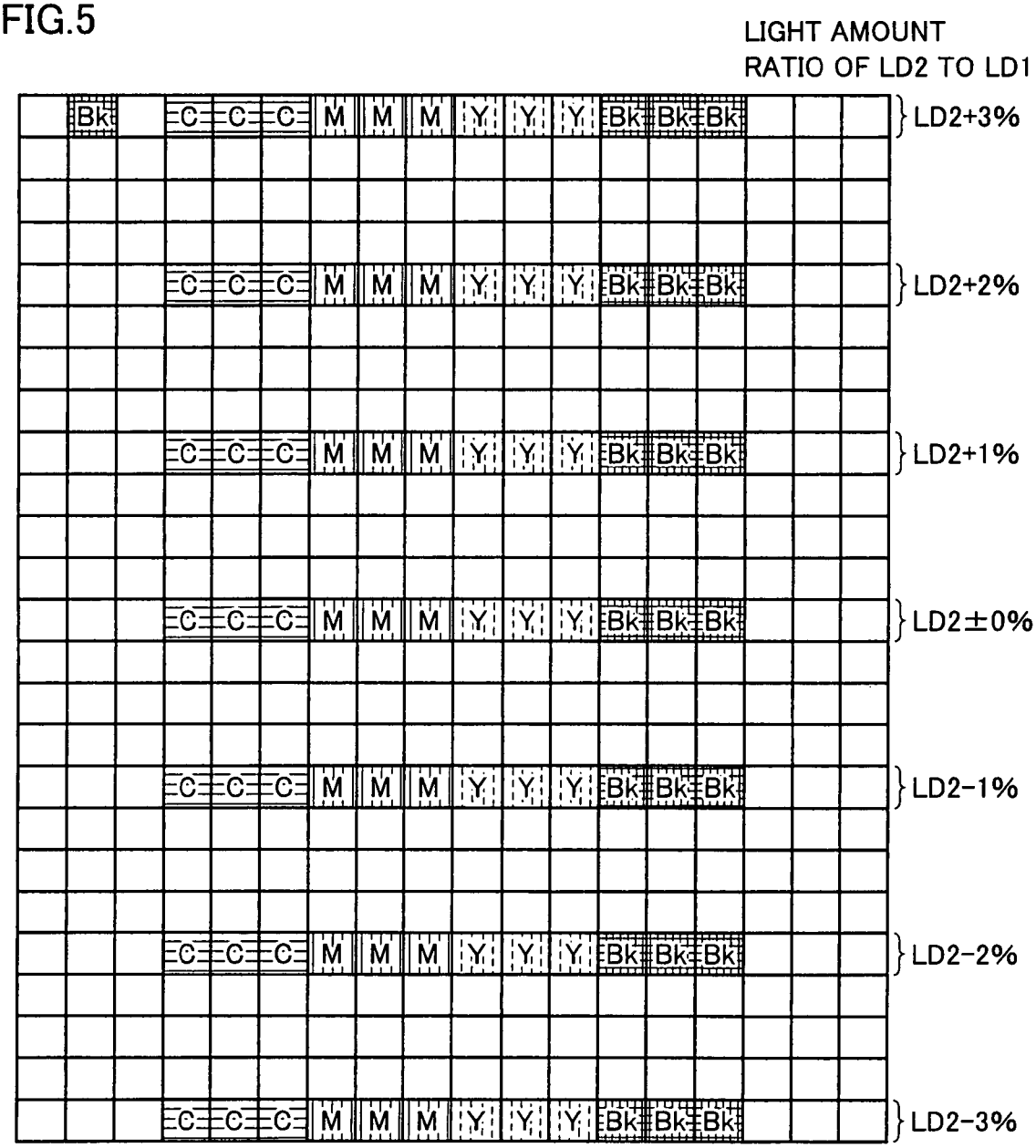
FIG. 5 illustrates a specific example of image patterns.

Note that the image patterns shown in FIG. 5 are one specific example and thus image patterns for adjustment used in the image forming apparatus according to the present invention are not limited to the image patterns shown in FIG. 5.

For example, a gradual change in the ratio of the amount of light from the other light source to the amount of light from the reference light source is not limited to the change on a one-percent-by-one-percent basis and may be a more detailed change or a broader change. The amount of change may be set in advance to copier 1 or an administrator or the like may set or change the amount of change. In addition, as will be described later, the smaller the amount of change, the more accurately an adjustment can be made; however, since a workload increases, the amount of change may be automatically set according to the processing capacity of copier 1. Alternatively, settings for the accuracy of adjustment of the ratio of the amounts of laser light and a workload (processing speed) may be accepted and the amount of change may be decided according to the settings.

The range of the ratio of the amount of light from the other light source to the amount of light from the reference light source is not limited to ±3% and may be greater than ±3% or smaller than ±3%. Since the range of the ratio is influenced by manufacturing variations in light sources LD1 and LD2, taking into account the manufacturing variations in light sources LD1 and LD2, the range of the ratio is preferably set in advance to copier 1. Alternatively, taking into account the manufacturing variations in light sources LD1 and LD2, an administrator or the like may set or change the range of the ratio. Alternatively, as with the above-described amount of change, the range of the ratio is associated with the accuracy of adjustment or a workload (processing speed), and thus, may be automatically set according to the processing capacity of copier 1. Alternatively, settings for the accuracy of adjustment of a laser light amount ratio and a workload (processing speed) may be accepted and the range of the ratio may be decided according to the settings. However, when a difference in the amount of laser light between light sources LD1 and LD2 is too large, appropriate image formation may not be performed; thus, as is determined in an adjustment process, as will be described later, by determining unit 109, the difference is preferably within a predetermined range, as will be described later. Therefore, in terms of the range of the ratio too, even when the upper and lower limits of the range of the ratio can be specified by the above-described predetermined range, settings are accepted as described above, or the range of the ratio is automatically calculated and set, it is preferable that the range of the ratio be set to be within a specified range. Specifically, when a set range of the ratio or a calculated range of the ratio is outside a specified range, it is preferable that the range of the ratio automatically fall within the specified range.

Figure 6:
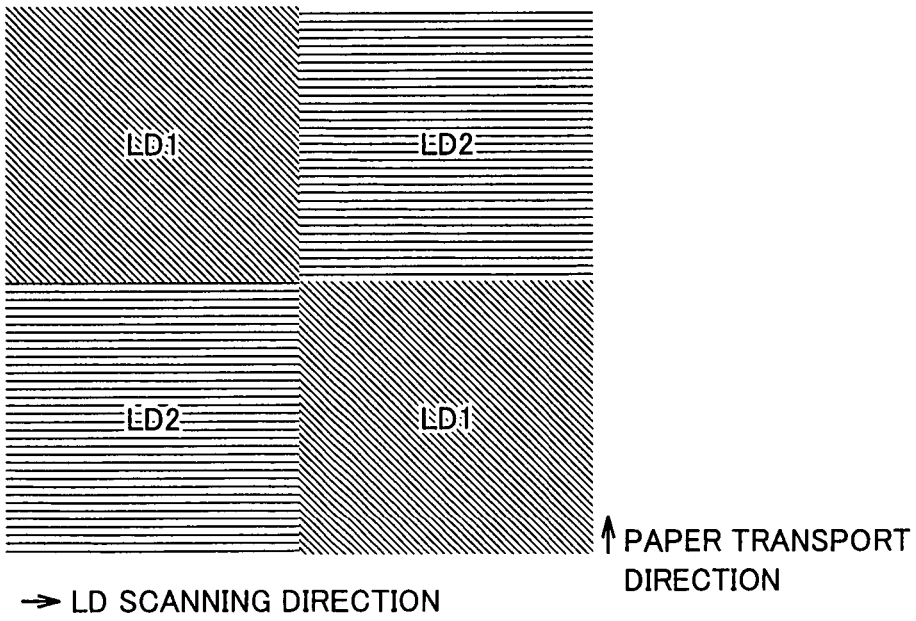
FIGS. 6 and 7 are diagrams describing an image pattern.
Figure 7:
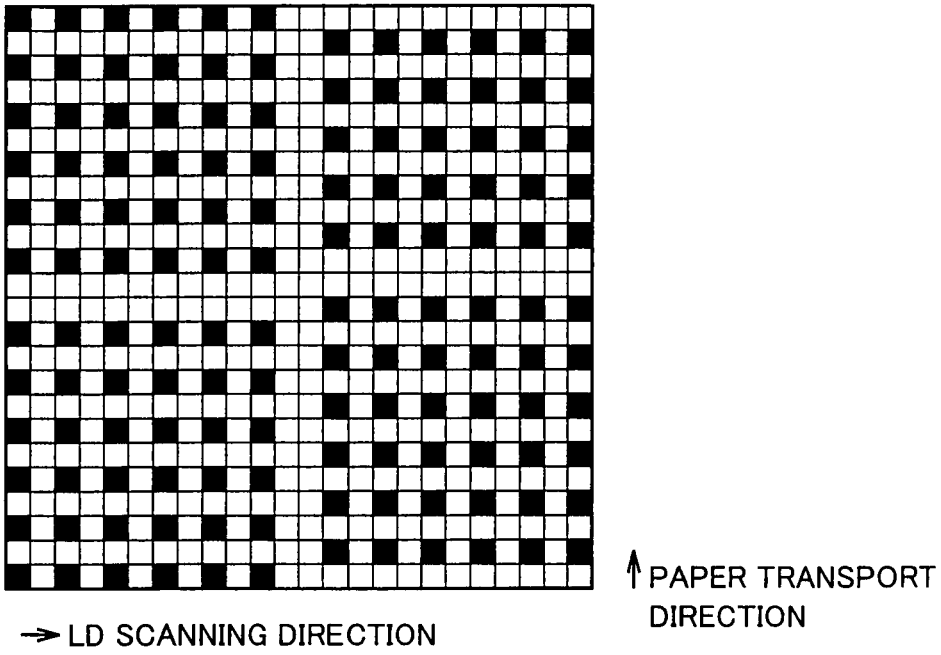

Each of the above-described areas includes small areas, such as those shown in FIG. 6, that are generated by exposure by light sources LD1 and LD2 and disposed in a lattice configuration. Each small area is composed of a dot pattern, such as the one shown in FIG. 7, that is generated by one of light sources LD1 and LD2 repeating on and off on a dot-by-dot basis. In this manner, isolated dots by light source LD1 and isolated dots by light source LD2 are formed. Note that, in the specific example, a spacing between adjacent isolated dots is equivalent to a single dot but may be equivalent to two or more dots.

Pattern reading unit 103 includes, in addition to controller 30, a hardware configuration such as photoelectric conversion element 2026 for reading an image from a document set on document table glass 201 in image reading unit 200 and generating an electrical signal. Pattern reading unit 103 reads, by reflected light from the above-described image pattern, the density of an image for a single dot by light source LD1 and the density of an image for a single dot by light source LD2 and inputs a detection signal according to the densities of the images to difference calculating unit 105. A density D is, for example, the logarithm of the reciprocal of a reflectance T to the base 10 and is defined as follows:

$$D=\log(1/T).$$

Difference calculating unit 105 is a function formed mainly in controller 30. Difference calculating unit 105 calculates, for each of the above-described ratios, a difference between the density of an image for a single dot by light source LD1 and the density of an image for a single dot by light source LD2 and inputs a result of the calculation to deciding unit 107 and determining unit 109.

Deciding unit 107 and determining unit 109 are also functions formed mainly in controller 30. Deciding unit 107 decides, as an adjustment ratio, a ratio at which the difference in density is smallest among differences in density calculated for each of the above-described ratios. Determining unit 109 compares the difference in density for the adjustment ratio with a threshold value. Then, when the difference in density is less than or equal to the threshold value, determining unit 109 determines that it is normal. When the difference in density is greater than the threshold value, determining unit 109 determines that trouble has occurred in exposure unit 301. A result of the determination is inputted to deciding unit 107. The threshold value is specifically on the order of 0.02 to 0.07 and is preferably 0.05.

Light-amount-ratio storage unit 111 corresponds mainly to a memory included in controller 30, a predetermined area of memory 40, or the like. Deciding unit 107 stores the decided adjustment ratio in light-amount-ratio storage unit 111 according to the determination result by determining unit 109.

Figure 8:
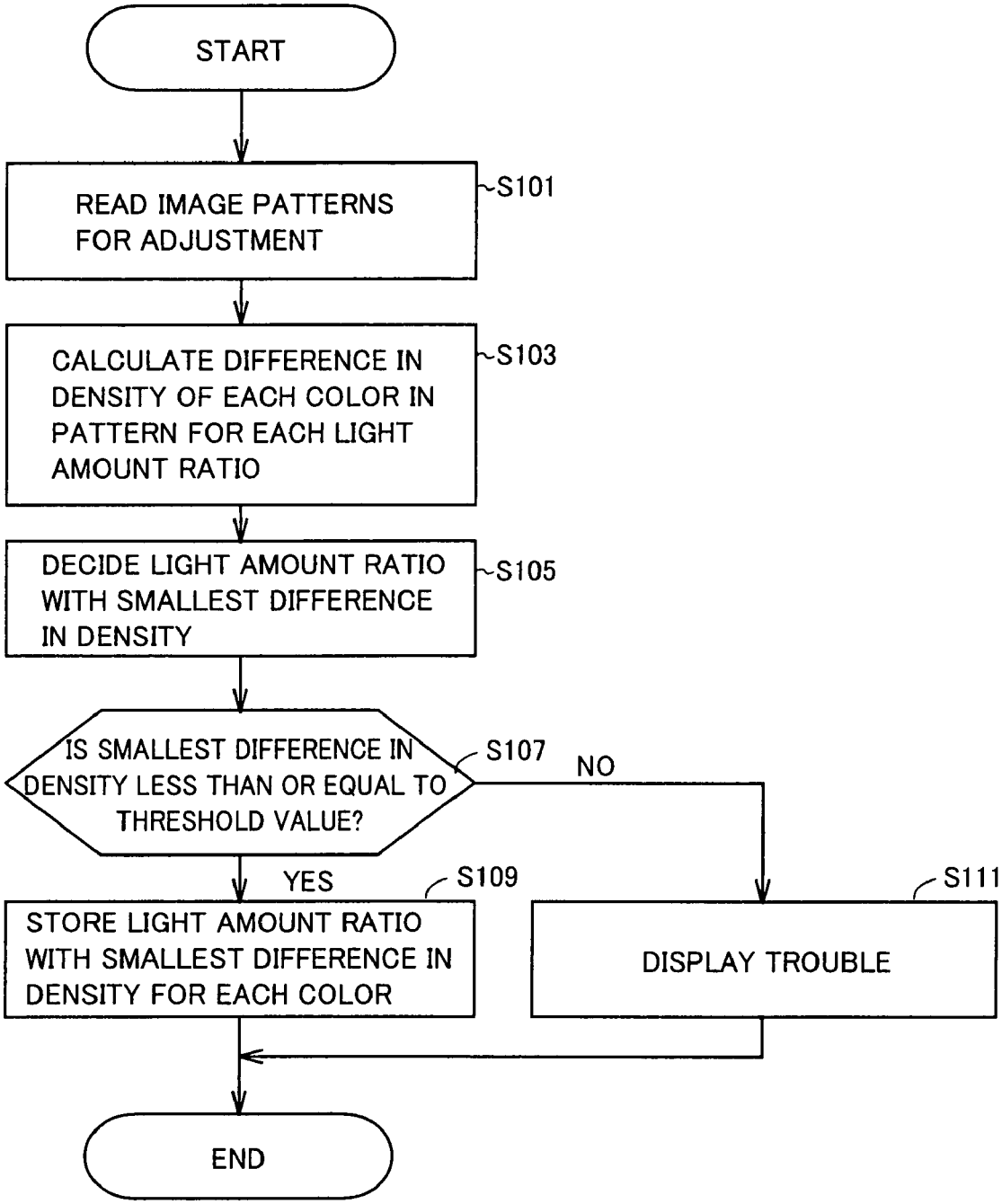
FIG. 8 is a flowchart showing a specific example of the process of adjusting the ratio of the amounts of laser light from light sources LD1 and LD2 by the image stabilization control.

The process of adjusting the ratio of the amounts of laser light from light sources LD1 and LD2 by image stabilization control, which is shown in a flowchart of FIG. 8, is performed when a key operation to instruct to start an adjustment process is performed on an instruction screen (not shown) that is displayed when a document having image patterns printed thereon based on image data stored in pattern storage unit 101 is set on automatic document transporting unit 100 or document table glass 201 and an instruction is provided on the screen shown in FIG. 4 to print the image patterns based on the image data stored in pattern storage unit 101. The adjustment process is implemented by controller 30 reading and executing a program stored in memory 40 and thereby controlling each unit shown in FIG. 3.

With reference to FIG. 8, first, pattern reading unit 103 reads image patterns for adjustment printed on a set document and detects a density of each color for each ratio (step S101). When the image patterns are the patterns shown in FIG. 5, in step S101, a density of a small area generated by exposure by light source LD1 and a density of a small area generated by exposure by light source LD2 are detected for each color and each ratio.

Difference calculating unit 105 calculates a difference in density between the small areas for each color and each ratio (step S103). Then, deciding unit 107 decides, for each color, a ratio with the smallest difference as an adjustment ratio (step S105).

If determining unit 109 determines that the above-described smallest difference for the ratio decided in the above-described step S105 is less than or equal to a threshold value, e.g., 0.05 or less (YES in step S105), then the ratio with the smallest difference decided in step S105 for each color is stored in light-amount-ratio storage unit 111 (step S109) and the process ends. If the above-described difference is determined to be greater than the threshold value, e.g., if the above-described difference is determined to be greater than 0.05 (NO in step S105), then determining unit 109 determines that trouble has occurred in exposure unit 301, display is provided on operation panel 50 to inform about the occurrence of trouble (step S111), and the process ends.

Figure 9:
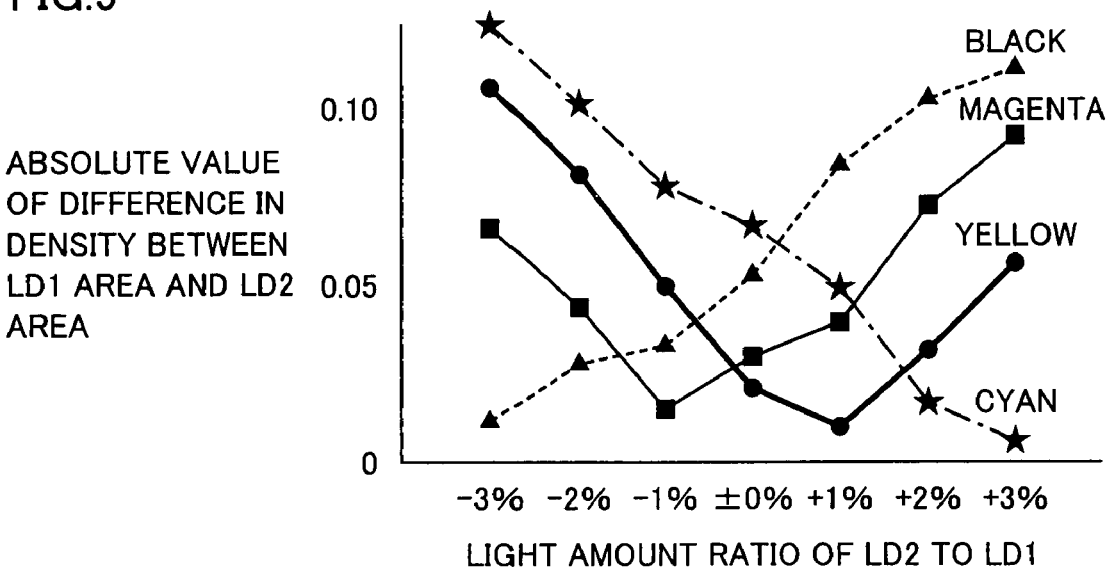
FIG. 9 illustrates a specific example of a difference in density by light sources LD1 and LD2 for each color.

When a difference in density between a small area generated by exposure by light source LD1 and a small area generated by exposure by light source LD2 for each color and each ratio is that shown in FIG. 9, in the above-described step S105, for yellow, a light amount ratio of light sources LD1 and LD2 in which the amount of light from light source LD2 is increased by 1% over the amount of light from light source LD1 is decided as an adjustment ratio. Similarly, for magenta, a light amount ratio of light sources LD1 and LD2 in which the amount of light from light source LD2 is reduced by 1% over the amount of light from light source LD1 is decided as an adjustment ratio. Similarly, for cyan, a light amount ratio of light sources LD1 and LD2 in which the amount of light from light source LD2 is increased by 3% over the amount of light from light source LD1 is decided as an adjustment ratio. Similarly, for black, a light amount ratio of light sources LD1 and LD2 in which the amount of light from light source LD2 is reduced by 3% over the amount of light from light source LD1 is decided as an adjustment ratio.

Figure 10:
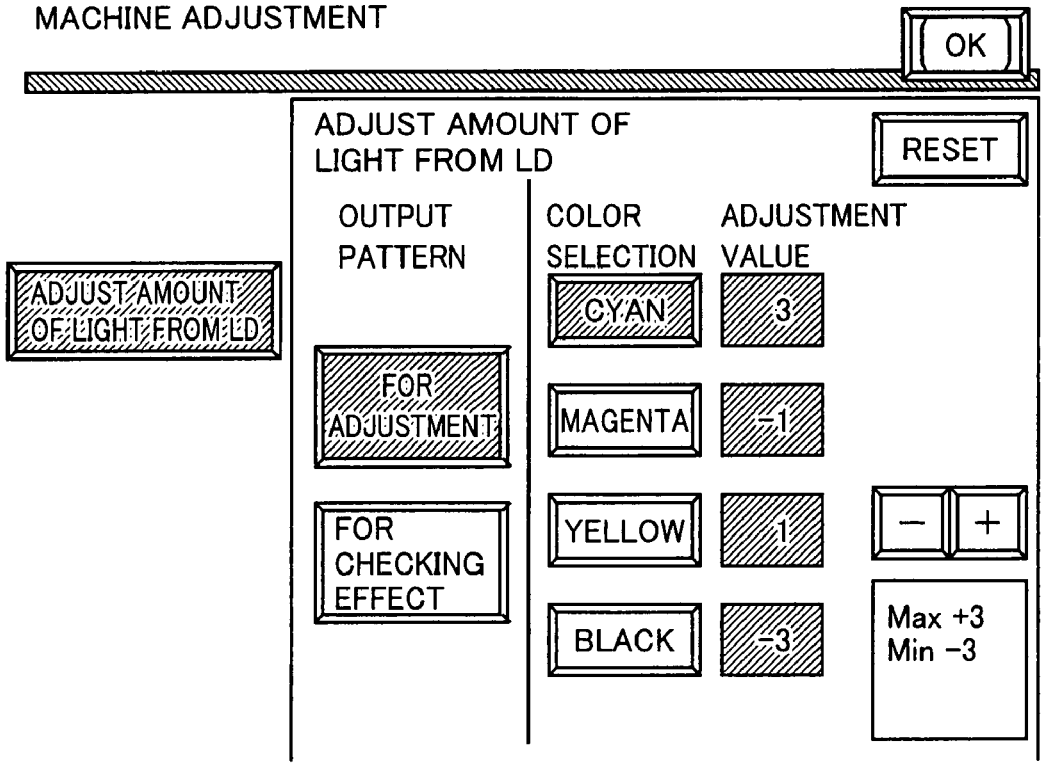
FIG. 10 illustrates a specific example of a screen for adjustment of a light amount ratio.

Note that although in the above-described step S105 adjustment ratios are automatically decided by difference calculating unit 105, it is also possible that in the above-described step S105 a screen for adjustment, such as one shown in FIG. 10, may be displayed on operation panel 50 and a setting for an adjustment ratio may be accepted for each color. In such a case, it is preferable that adjustment ratios decided by difference calculating unit 105 be inputted in advance on the screen for adjustment as the defaults. Since, as described above, the light amount ratio of light sources LD1 and LD2 is preferably within a predetermined range, it is preferable that, as shown in FIG. 10, a settable range of the ratio be provided on the screen for adjustment. Alternatively, any setting beyond the above-described range may not be accepted. Alternatively, after an input of a ratio is accepted, by pressing a button for checking an effect with that ratio, image patterns for the case in which light sources LD1 and LD2 are exposed at that ratio may be printed.

In copier 1 according to the present embodiment, such an adjustment process is performed, whereby an optimal laser light amount ratio of light sources LD1 and LD2 is decided for each color and correction data that provides the laser light amount ratios is generated. The correction data is stored in a predetermined area of memory 40. Upon forming an image, controller 30 reads the correction data from memory 40 and outputs the correction data to exposure unit 301. Drive circuits 3011 of exposure unit 301 input drive signals including control signals for controlling the light emission intensities of light sources LD1 and LD2 to light sources LD1 and LD2 such that exposure is performed at the laser light amount ratios based on the inputted correction data. By this, exposure is performed at optimal laser light amount ratios decided upon forming the image.

Note that copier 1 may includes at least one of a measuring unit (not shown) that measures ambient temperatures of light sources LD1 and LD2 and a counting unit (not shown) that counts total light emission times of light sources LD1 and LD2. In such a case, it is preferable that controller 30 use the measuring unit and the counting unit to control light emission intensities by obtaining ambient temperatures of light sources LD1 and LD2 from the measuring unit, obtaining total light emission times of light sources LD1 and LD2 from the counting unit, and further correcting correction data based on the obtained temperatures and total light emission times. A specific correction method is not limited to any particular method in the present invention.

Since the change in ambient temperature and the total light emission times of lasers exert an influence on the light emission intensities of the lasers, by taking those into account, a more excellent image can be formed.

By performing exposure at laser light amount ratios of light sources LD1 and LD2 that are decided as adjustment ratios in the adjustment process, the difference in area of light emission waveform between light sources LD1 and LD2 can be made small. That is, the difference in density between isolated dots by light source LD1 and isolated dots by light source LD2 can be made small. Thus, even when any of isolated dots is biased in an output image, variation in density can be suppressed. In addition, the reproducibility variance for a minute dot such as one dot can be made small. By this, a more excellent image can be formed.

(First Variant)

Figure 11:
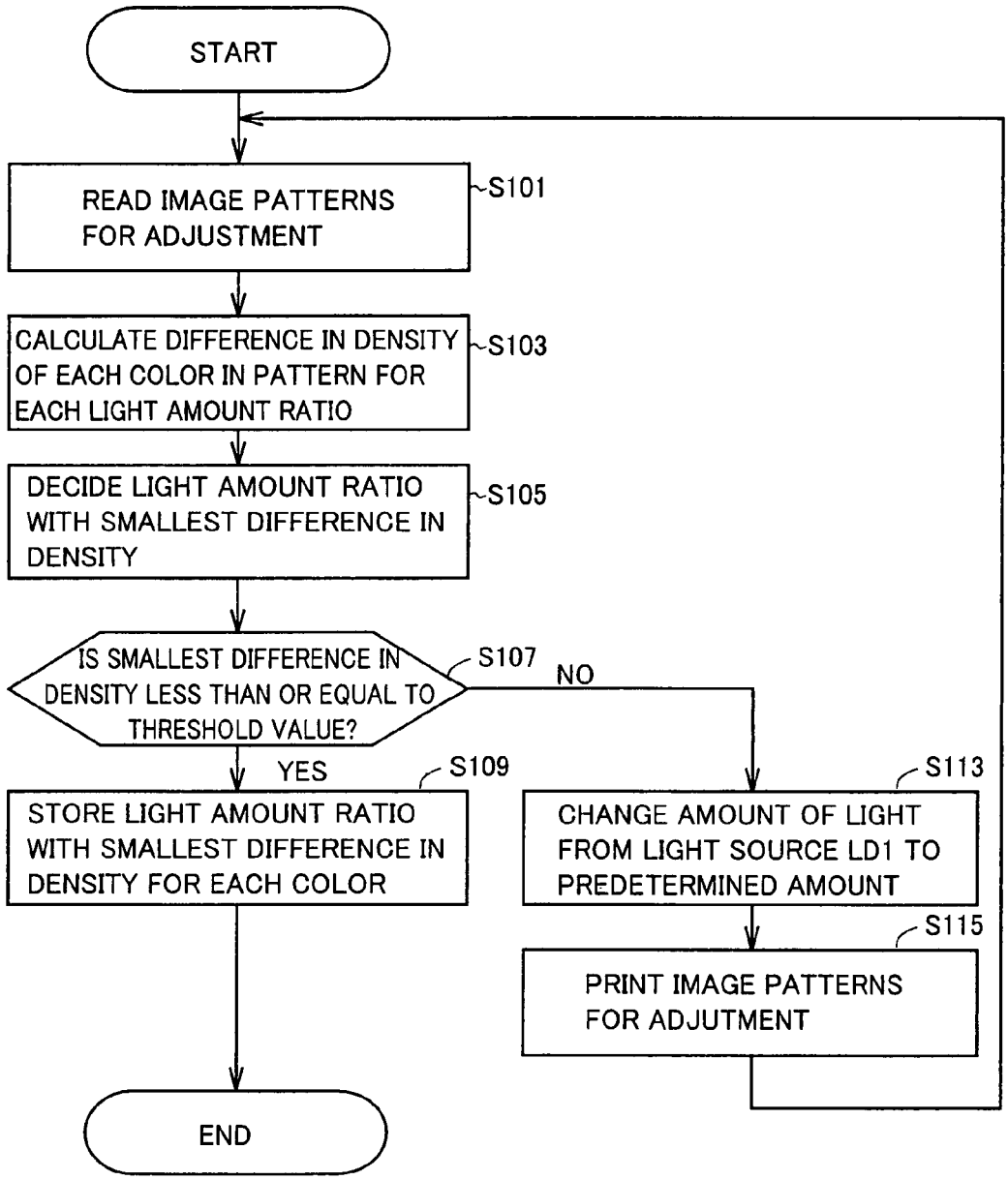
FIG. 11 is a flowchart showing a specific example of a process of adjusting the ratio of the amounts of laser light from light sources LD1 and LD2, in a variant.
Figure 12A:
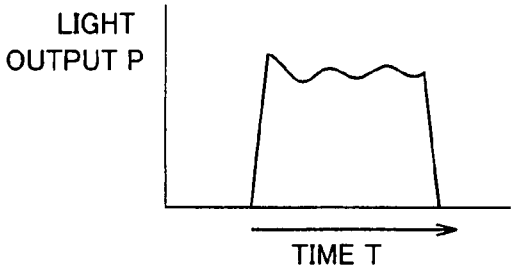
FIGS. 12A and 12B illustrate specific examples of light emission waveforms of light sources LD1 and LD2 for a single dot.
Figure 12B:
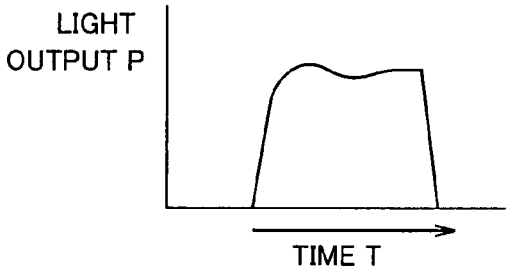

The above-described specific example describes a method in which one of two light sources LD1 and LD2, i.e., light source LD1, is used as a reference light source and the ratio of the amount of light from the other light source LD2 to the amount of light from the reference light source LD1 is adjusted. However, in a process according to a first variant, as shown in FIG. 11, if it is determined in the above-described step S105 that the smallest difference between the density by light source LD1 and the density by light source LD2 is greater than the threshold value, i.e., if it is determined in the above-described process that the amount of light from light source LD2 cannot be made equal to the amount of light from light source LD1 (NO in step S105), then instead of providing display in the above-described step S111, the amount of light from light source LD1 may be changed to a predetermined amount in step S113 and image patterns for adjustment may be printed in step S115, and thereafter, the above-described process may be repeated again.

By doing so, the difference in density between isolated dots by light source LD1 and isolated dots by light source LD2 can be made further smaller.

(Second Variant)

The leading edges of light emission waveforms of light sources LD1 and LD2 being different from each other exerts a significant influence particularly when reproducing minute dots. In other words, when dots of a predetermined number N or more which are not minute continue in a laser exposure-scanning direction, a significant influence of differing leading edges of light emission waveforms of light sources LD1 and LD2 is not exerted.

Hence, in a copier 1 according to a second variant, controller 30 scans in advance image data to be outputted and thereby detects continuation of dots and determines whether the number of continuation dots is greater than or equal to the predetermined number N. If, as a result of the determination, it is determined that N or more dots continue, then controller 30 does not control the light emission intensities of the light sources using adjustment ratios determined in the above-described adjustment process and thus drive signals for controlling the light emission intensities are not outputted from drive circuits 3011.

The same applies to the case in which a copier 1 can adopt a plurality of tone reproduction methods and the plurality of tone reproduction methods include a method, such as an error diffusion method, in which without dots that are created by exposure by one of a plurality of light sources, being concentrated on a certain area, dots created by exposure by the light sources are regularly mixed. That is, in such a case too, it can be considered that occurrence of variation in density resulting from differing leading edges of light emission waveforms of light sources LD1 and LD2 is not conspicuous, and thus, similarly, controller 30 may not control the light emission intensities of the light sources using adjustment ratios decided in the above-described adjustment process.

The above-described specific example describes a method in which one of two light sources LD1 and LD2 is used as a reference light source and the ratio of the amount of light from the other light source to the amount of light from the reference light source is adjusted. However, the number of light sources provided to a copier is not limited to two and may be three or more. In such a case too, as with the above-described specific example, one of a plurality of light sources is used as a reference light source and the ratio of the amount of light from each of the rest of the light sources to the amount of light from the reference light source is adjusted.

Furthermore, it is also possible to provide a program for causing a computer to perform an adjustment process performed in copier 1 according to the present embodiment. Such a program can also be provided as a program product by storing the program on a computer-readable storage medium such as a flexible disk, a CD-ROM (Compact Disk-Read Only Memory), a ROM (Read Only Memory), a RAM (Random Access Memory), or a memory card, which is attached to a computer. Alternatively, the program can also be provided by storing the program on a storage medium such as a hard disk that is built in a computer. Alternatively, the program can also be provided by downloading the program via a network.

The program according to the present invention may cause a computer to perform a process by calling, among program modules provided as part of an operating system (OS) of the computer, necessary modules in a predetermined array and at predetermined timing. In such a case, the program itself does not include the above-described modules and the process is performed in cooperation with the OS. Such a program that does not include modules can also be included in the program according to the present invention.

The program according to the present invention may be provided by being incorporated as part of another program. In such a case too, the program itself does not include modules included in the above-described another program and a process is performed in cooperation with the above-described another program. Such a program that is incorporated into another program can also be included in the program according to the present invention.

The program product to be provided is installed on a program storage unit such as a hard disk and executed. The program product includes the program itself and a storage medium having stored thereon the program.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a first exposure light source and a second exposure light source configured to form a latent image on an image carrier by dot exposure;

a storage unit configured to store image data for printing an image for adjustment;

an adjusting unit configured to adjust an amount of light from said first exposure light source and an amount of light from said second exposure light source by using a pattern image for adjustment in an adjustment process; and a control unit configured to control a light emission intensity of said first exposure light source and a light emission intensity of said second exposure light source so as to render the amounts of light adjusted by said adjusting unit, said adjusting unit comprising:

a pattern image forming unit, in the adjustment process, configured to determine a plurality of ratios based on a change in relative amounts of the light emission intensity of said first exposure light source and the light emission intensity of said second exposure light source, and to form said pattern image comprising, for each said ratio of the plurality of ratios, a first area comprising only first isolated dots created by said first exposure light source repeating on and off on a dot-by-dot basis and a second area comprising only second isolated dots created by said second exposure light source repeating on and off on a dot-by-dot basis, and a deciding unit configured to decide an adjustment ratio based on a difference between a density of said first area and a density of said second area for each said ratio, wherein said control unit controls said light emission intensity of said first exposure light source and said light emission intensity of said second exposure light source based on said adjustment ratio.

2. The image forming apparatus according to claim 1, wherein said adjusting unit further includes:

a reading unit to read, for each said ratio, the density of said first area and the density of said second area in said image for adjustment; and a difference calculating unit to calculate, for each ratio, said difference between the density of said first area and the density of said second area, and said deciding unit decides, as said adjustment ratio, said ratio at which said difference between the density of said first area and the density of said second area is smallest.

3. The image forming apparatus according to claim 2, wherein said deciding unit decides, as said adjustment ratio, said ratio when said difference being smallest is less than or equal to a threshold value.

4. The image forming apparatus according to claim 1, wherein said first area is formed only of said first isolated dot formed by said first exposure light source, and said second area is formed only of said second isolated dot formed by said second exposure light source.

5. The image forming apparatus according to claim 1, further comprising a unit to accept a change in said adjustment ratio.

6. The image forming apparatus according to claim 1, further comprising at least one of a first obtaining unit to obtain temperatures in a vicinity of said first exposure light source and said second exposure light source and a second obtaining unit to obtain total light emission times of said first exposure light source and said second exposure light source, wherein said control unit further controls said light emission intensity of said first exposure light source and said light emission intensity of said second exposure light source, based on said temperatures in the vicinity of said first exposure light source and said second exposure light source and/or said total light emission times of said first exposure light source and said second exposure light source.

7. The image forming apparatus according to claim 1, wherein when said control unit detects that dots of a predetermined number or more continue in an image to be outputted, said control unit controls said light emission intensity of said first exposure light source and said light emission intensity of said second exposure light source so as to render said amounts of light in said adjustment ratio.

8. An image forming method for an image forming apparatus including a first exposure light source and a second exposure light source for forming a latent image on an image carrier by dot exposure, said method comprising the steps of:

scanning a pattern image for adjustment in an adjustment process that is printed by said image forming apparatus, said pattern image being formed by determining a plurality of ratios based on a change in relative amounts of a light emission intensity of said first exposure light source and a light emission intensity of said second exposure light source, and to form said pattern image comprising, for each said ratio of the plurality of ratios, a first area comprising only first isolated dots created by said first exposure light source repeating on and off on a dot-by-dot basis and a second area comprising only second isolated dots created by said second exposure light source repeating on and off on a dot-by-dot basis;

reading, for each said image area, a density of said first area and a density of said second area in said pattern image;

calculating, for each said image area, a difference between the density of said first area and the density of said second area;

deciding an adjustment ratio for the adjustment process based on the difference between the density of said first area and the density of said second area; and controlling, upon forming an image, said light emission intensity of said first exposure light source and said light emission intensity of said second exposure light source so as to render said amounts of light in said adjustment ratio.

9. A computer-readable storage medium embodying a computer program that, when executed by a computer associated with an image forming apparatus including a first exposure light source and a second exposure light source for forming a latent image on an image carrier by dot exposure, said computer program product causes said computer to perform the steps of:

scanning a pattern image for adjustment in an adjustment process that is printed by said image forming apparatus, said pattern image being formed by determining a plurality of ratios based on a change in relative amounts of a light emission intensity of said first exposure light source and a light emission intensity of said second exposure light source, and to form said pattern image comprising, for each said ratio of the plurality of ratios, a first area comprising only first isolated dots created by said first exposure light source repeating on and off on a dot-by-dot basis and a second area comprising only second isolated dots created by said second exposure light source repeating on and off on a dot-by-dot basis;

reading, for each said image area, a density of said first area and a density of said second area in said pattern image;

calculating, for each said image area, a difference between the density of said first area and the density of said second area;

deciding an adjustment ratio for the adjustment process based on the difference between the density of said first area and the density of said second area; and controlling, upon forming an image, said light emission intensity of said first exposure light source and said light emission intensity of said second exposure light source so as to render said amounts of light in said adjustment ratio.

* * * * *